US008202174B2

(12) United States Patent
Breier et al.

(10) Patent No.: US 8,202,174 B2
(45) Date of Patent: Jun. 19, 2012

(54) GOLF CLUB

(75) Inventors: Joshua G. Breier, Vista, CA (US); John Morin, La Jolla, CA (US); Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 305 days.

(21) Appl. No.: 12/709,679

(22) Filed: Feb. 22, 2010

(65) Prior Publication Data

US 2011/0207551 A1 Aug. 25, 2011

(51) Int. Cl.
*A63B 53/04* (2006.01)

(52) U.S. Cl. ..... 473/332; 473/350

(58) Field of Classification Search ..... 473/332, 473/350

See application file for complete search history.

(56) References Cited

U.S. PATENT DOCUMENTS

| | | | | |
|---|---|---|---|---|
| 3,814,437 | A | 6/1974 | Winquist | |
| D235,668 | S | 7/1975 | Swash | |
| 4,826,172 | A | 5/1989 | Antonious | |
| 4,836,550 | A | 6/1989 | Kobayashi | |
| 5,014,993 | A * | 5/1991 | Antonious | 473/350 |
| 5,295,689 | A | 3/1994 | Lundberg | |
| 5,328,184 | A | 7/1994 | Antonious | |
| 6,015,354 | A | 1/2000 | Ahn et al. | |
| 6,027,415 | A | 2/2000 | Takeda | |
| 6,077,173 | A | 6/2000 | Stites | |
| 6,309,311 | B1 | 10/2001 | Lu | |
| 7,056,229 | B2 | 6/2006 | Chen | |
| 2001/0044345 | A1 | 11/2001 | Stites | |
| 2009/0131199 | A1 * | 5/2009 | Gilbert et al. | 473/332 |
| 2009/0325729 | A1 | 12/2009 | Takechi | |

FOREIGN PATENT DOCUMENTS

| | | |
|---|---|---|
| JP | 9 239077 | 9/1997 |

OTHER PUBLICATIONS

European Search Report dated Jun. 29, 2011 in Application No. 11 154 821.

* cited by examiner

*Primary Examiner* — Gene Kim
*Assistant Examiner* — Michael Dennis
(74) *Attorney, Agent, or Firm* — Mark S. Leonardo; Brown Rudnick LLP

(57) ABSTRACT

A golf club includes a golf club head that is generally constructed as a perimeter weighted golf club head and comprises a perimeter body, a hosel, at least one truss member and a face. The truss member extends between portions of the perimeter body to tune the vibration and deflection response of the golf club head in response to a golf ball impact.

19 Claims, 10 Drawing Sheets

GOLF CLUB

FIELD OF THE INVENTION

This invention generally relates to golf clubs, and more specifically to a golf club having a truss structure.

BACKGROUND OF THE INVENTION

Typical iron club heads are solid with a flat hitting face and generally have either a muscle back or a cavity back configuration. Traditionally, all irons had a muscle back configuration, which includes a thicker lower portion, a low offset hosel, a thin top line, a thin sole, and no substantial rear concavity.

Irons with a cavity back configuration have material concentrated toward an outer periphery of the head to form a perimeter weight that defines a rear cavity. The cavity back configuration is used to provide mass distribution that makes the golf clubs more forgiving for less skilled users. For example, the cavity back configuration may be used to locate the center of gravity lower to the ground and rearward to launch a struck golf ball higher. The construction is also generally used to increase the rotational moment of inertia to reduce the golf club's tendency to rotate during imperfect ball strikes thereby providing better directional control.

Additionally, various constructions have been introduced that combine attributes of the muscle back and cavity back constructions. For example, some irons-type club heads include an upper cavity portion and a lower muscle portion. That hybrid construction provides increased forgiveness over a traditional muscle back configuration while providing more efficient energy transfer and improved workability as compared to a pure cavity back construction.

The cavity back and hybrid constructions have been further manipulated to further tune the performance. For example, multi-material constructions have been introduced that incorporate materials having various densities so that the center of gravity can be precisely located. In particular, some golf club heads utilize a body constructed of a medium density material, a face insert constructed of a low density material and sole weight members constructed of a high density material. Additionally, some golf club heads have replaced a portion of the perimeter weight at least partially with a low density material, and oftentimes a portion of the top line is replaced with a low density material to further lower the location of the center of gravity.

Unfortunately, those further manipulations have also altered the vibration and deflection characteristics of the golf club head which contribute to the feel, directional control and energy transfer to the golf ball during impact. Little has been done to structurally tune the golf club body to counteract the deleterious effect of those mass manipulations. Instead, many golf club manufacturers rely solely on a back plate component that is attached to the golf club head and constructed, at least in part, with viscoelastic materials so that they partially dampen undesired vibration.

There remains a need in the art for an improved golf club that includes a structure that tunes the vibration and deflection characteristics of the golf club head.

SUMMARY OF THE INVENTION

The present invention is directed to golf club heads having improved structure. In particular, a golf club head includes at least one truss member to tune the vibration characteristics during ball impact.

In an embodiment, a golf club head includes a perimeter body, a face, a hosel and at least one truss member. The perimeter body includes a top line and a sole portion. The face is disposed on a front portion of the perimeter body, and the face and the perimeter body define a rear cavity. The face and the sole portion are coupled at a periphery of the face to define a channel between the sole portion and the face. The hosel is disposed at a heel end of the face and the perimeter body. The at least one truss member extends across at least a portion of the rear cavity and mechanically couples the sole portion and an area of the top line exhibiting maximum displacement of a vibration mode in a frequency less than 5500 Hz.

In another embodiment, a golf club head includes a perimeter body, a face, a hosel and at least one truss member. The perimeter body includes a top line and a sole portion that forms a lower muscle portion. The lower muscle portion is at least partially hollow to define a lower cavity. The face is disposed on a front portion of the perimeter body, and the face and the perimeter body define an upper rear cavity in an upper portion of the golf club head. The hosel is disposed at a heel end of the face and the perimeter body. The at least one truss member extends across at least a portion of the upper rear cavity and mechanically couples the sole portion and an area of the top line exhibiting maximum displacement of a vibration mode in a frequency less than 5500 Hz.

In another embodiment, a golf club head includes a perimeter body, a face, a hosel and at least one truss member. The perimeter body includes a top line and a sole portion. The face is disposed on a front portion of the perimeter body, and the face and the perimeter body define a rear cavity. The hosel is disposed at a heel end of the face and the perimeter body. The at least one truss member extends across at least a portion of the rear cavity and mechanically couples an area of the sole portion and an area of the top line. The area of the top line exhibits maximum displacement of a vibration mode in a frequency less than 5500 Hz. The area of the sole portion exhibits maximum displacement of a vibration mode in a frequency less than 10,000 Hz.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
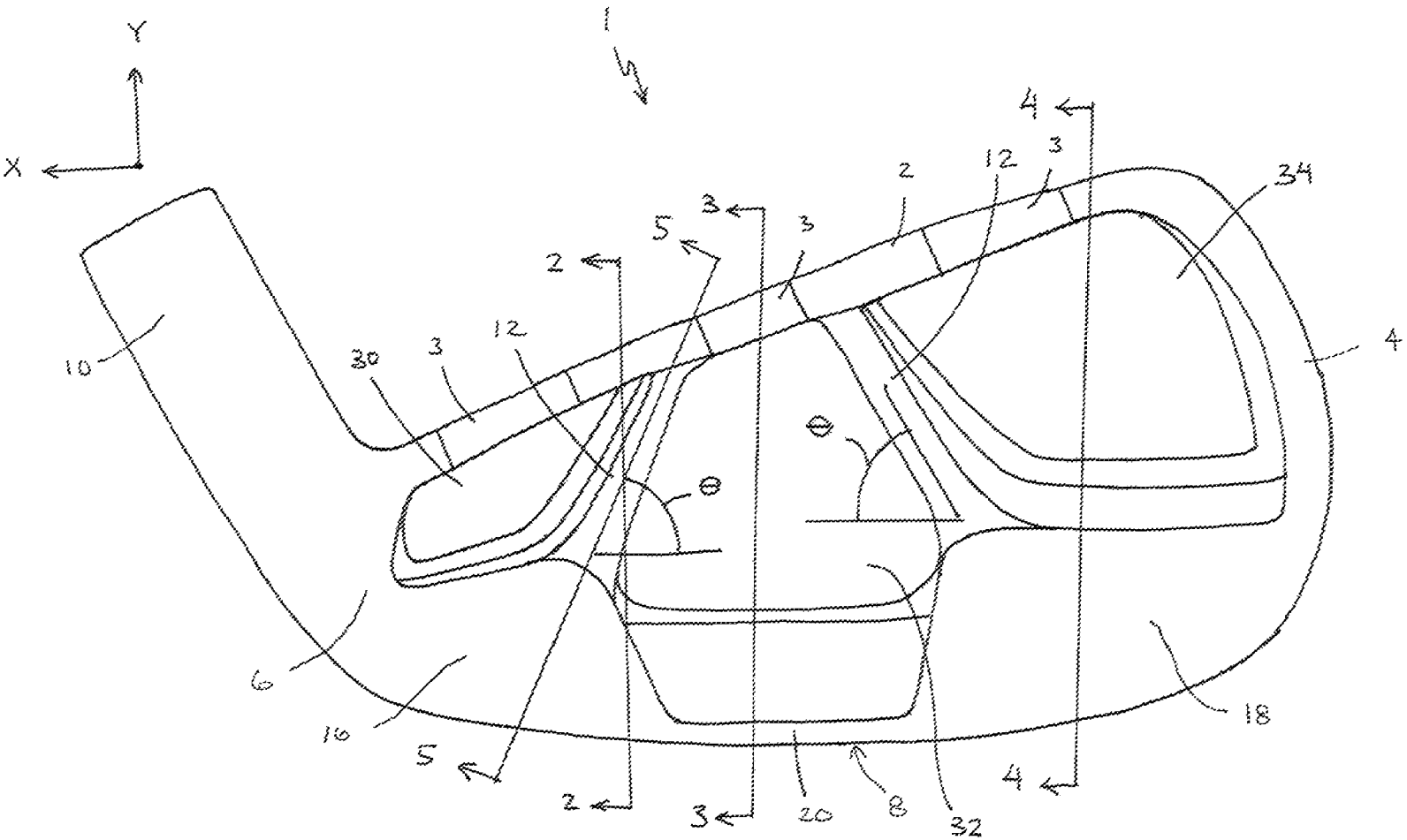
FIG. 1 is a rear view of a golf club in accordance with the present invention.
Figure 4:
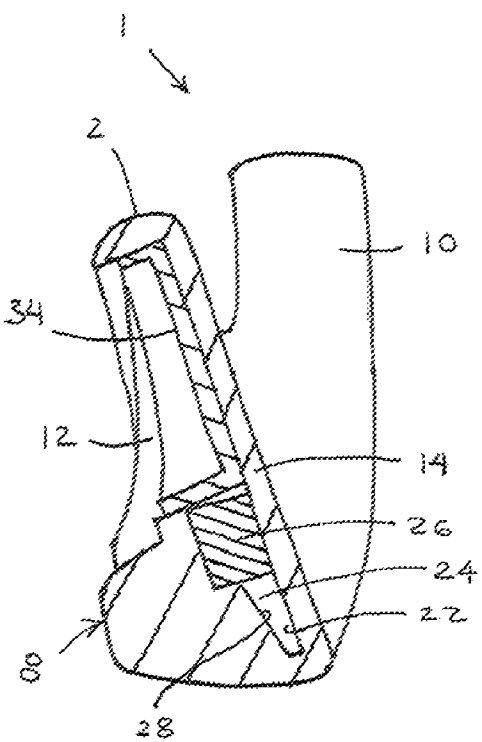
FIG. 4 is a cross-sectional view taken along line 4-4 of FIG. 1.
Figure 3:
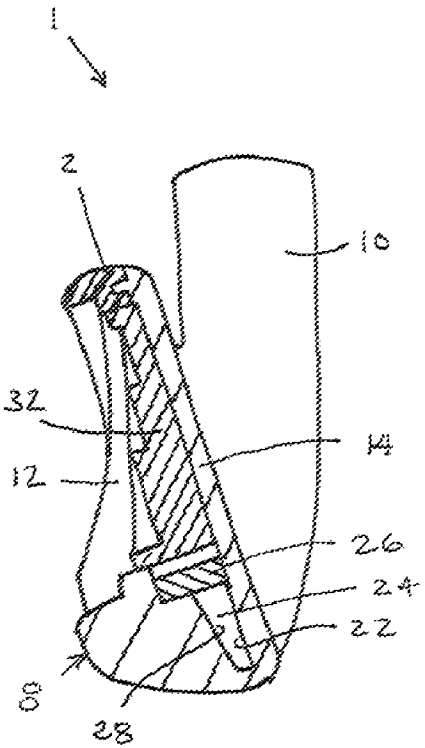
FIG. 3 is a cross-sectional view taken along line 3-3 of FIG. 1.
Figure 2:
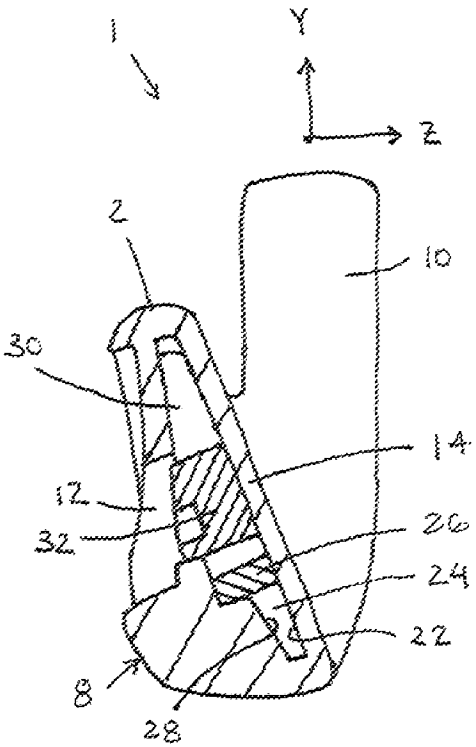
FIG. 2 is a cross-sectional view taken along line 2-2 of FIG. 1.

The present invention is directed to golf clubs having a truss structure in a rear portion of the golf club head. In particular, the truss structure is configured to alter the vibration characteristics of portions of the golf club head. The end result of the present invention is a club that provides improved sound, feel and distance control. Several embodiments of the present invention are described below.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Referring first to FIGS. 1-5, an embodiment of an iron-type golf head 1 including a truss structure will be described. Club head 1 is generally constructed as a perimeter weighted cavity back golf club head and comprises a perimeter body, a hosel 10, at least one truss member 12 and a face 14.

The perimeter body includes a top line 2, a toe portion 4, a heel portion 6, and a sole portion 8 and provides mass distribution of golf club head 1 that increases the moment of inertia by concentrating the mass of the club head at the perimeter of face 14. Sole portion 8 may further include mass concentrations to further tune the mass properties of club head 1. For example, in the present embodiment, sole portion 8 includes a heel mass 16 and a toe mass 18 and a central portion 20. Central portion 20 has a reduced height that combines with heel mass 16 and toe mass 18 to increase the moment of inertia about a Y-axis extending through the center of gravity of golf club head 1.

Face 14 is disposed on the perimeter body and provides a front ball striking surface. Face 14 may have a constant thickness, as shown, generally between about 1.5 mm and about 4.0 mm or it may have a variable thickness. For example, the face may have regions of greater thickness than other regions and in embodiments in which the truss members divide the face into portions, the portions may have different thicknesses. In other embodiments, the face may include a thicker lower portion adjacent the sole portion. Additionally, face 14 may be formed integral with perimeter body or as a separate component that is coupled to the perimeter body. Face 14 may be constructed from the same or a different material than the perimeter body and hosel 10, and it combines with the perimeter body to define a rear cavity.

The perimeter body may also be altered to provide discretionary mass. For example, top line 2 may include inserts 3 that are constructed of materials that are different than the remainder of top line 2. Preferably, inserts 3 are constructed from a material having a lower density than the material of the remainder of top line 2 so that the overall mass of top line 2 is reduced. It should be appreciated that inserts may be incorporated into any portion of the perimeter body including top line 2, toe portion 4, heel portion 6, and sole portion 8. Additionally, the material of the inserts is generally selected based on the location of the particular insert. In an embodiment, inserts included above a preselected height are constructed from a material, or materials, having a lower density than the remainder of the perimeter body, and inserts below that preselected height are constructed from a material, or materials, having higher density than the remainder of perimeter body. The discretionary mass may be dedicated to alter the mass characteristics of the golf club head, such as by using it to lower the location of the center of gravity or to increase the moment of inertia. Additionally, some of that discretionary mass may be utilized in the construction of truss members 12.

Hosel 10 is disposed on a heel end of face 14 and the perimeter body, and provides an attachment to a shaft so that club head 1 may be assembled into a complete golf club. Hosel 10 may be constructed integral with face 14 and/or the perimeter body. Hosel 10 may also be constructed from the same, or a different, material than face 14 and/or the perimeter body.

Referring to FIGS. 2-5, golf club 1 is constructed to have a channel back configuration. In particular, sole portion 8 of the perimeter body is coupled to a back surface 22 of face 14 only at the perimeter thereof and the remainder of sole portion 8 is spaced from back surface 22 to define a channel 24. Channel 24 may be used to alter the location of the center of gravity of the club head and/or to alter the flexibility of face 14.

Golf club head 1 also includes at least one truss member 12. In the present embodiment, a pair of truss members 12 extend from sole portion 8 to top line 2 across the rear cavity. Preferably, truss members 12 extend to at least one portion of club head 1 that exhibits maximum displacement in at least one vibration mode in a frequency of less than about 10,000 Hz. More preferably, truss members 12 extend to a portion of the club head that exhibits maximum displacement in a vibration mode in a frequency of less than about 5500 Hz.

Truss members 12 are generally constructed as beams that extend between portions of golf club head 1. In the present embodiment, truss members 12 extend, unsupported, between sole portion 8 and top line 2. Truss members 12 extend between portions of top line 2 and sole portion 8 that exhibit maximum deflection in different vibration modes of club head 1. As a result, the displacement of each of those portions in the respective vibration mode is reduced and the vibration frequency is tuned to a more desirable frequency. By reducing the vibration displacement and tuning the frequency, the energy that would otherwise be wasted on vibration of the golf club head may be directed into the struck golf ball to provide a more efficient energy transfer.

The vibration characteristics of the golf club head are used to locate truss members 12. A golf club having the structure of club head 1 without truss members 12 was compared analytically to the structure of club head 1 using finite element analysis (FEA). The analysis provided a comparison of the vibration behavior of the golf club heads, which was used to tune the structure of the golf club head so that energy is more efficiently transferred during impact.

Figure 6:
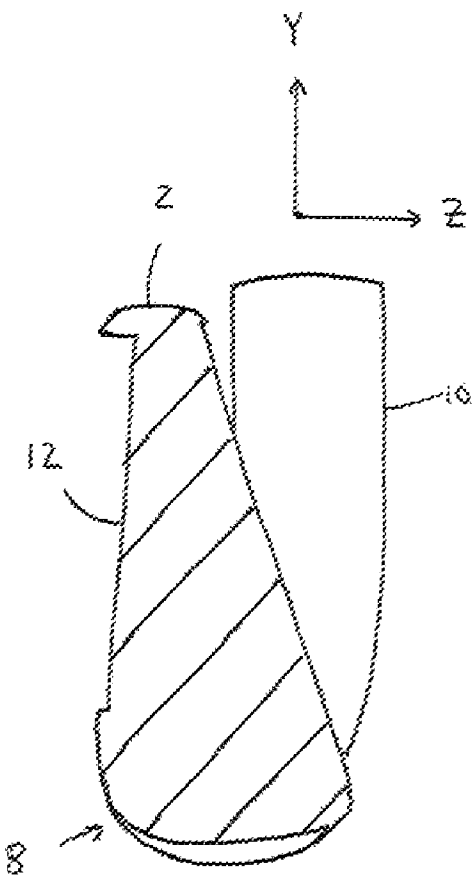
FIG. 6 is an alternative cross-sectional view corresponding to a view taken along line 5-5 of FIG. 1.

In particular, the golf club head without the truss members was analyzed and was determined to exhibit a top line vibration mode, i.e., a vibration mode in which the top line exhibits the maximum displacement of the mode, at a frequency of less than 4500 Hz, as shown schematically in FIG. 6. After the addition of truss members 12, the vibration behavior of club head 1 still included a top line vibration mode, but the frequency was increased above 4500 Hz and the magnitude of the displacement was reduced. For example, frequency of the top line vibration mode was increased from about 4190 Hz. to about 4960 Hz. by the addition of truss members 12. Preferably, truss members 12 are constructed to extend across a portion of the rear cavity to a portion of the golf club head that exhibits maximum displacement in a vibration mode having a frequency of less than 4500 Hz.

Figure 7:
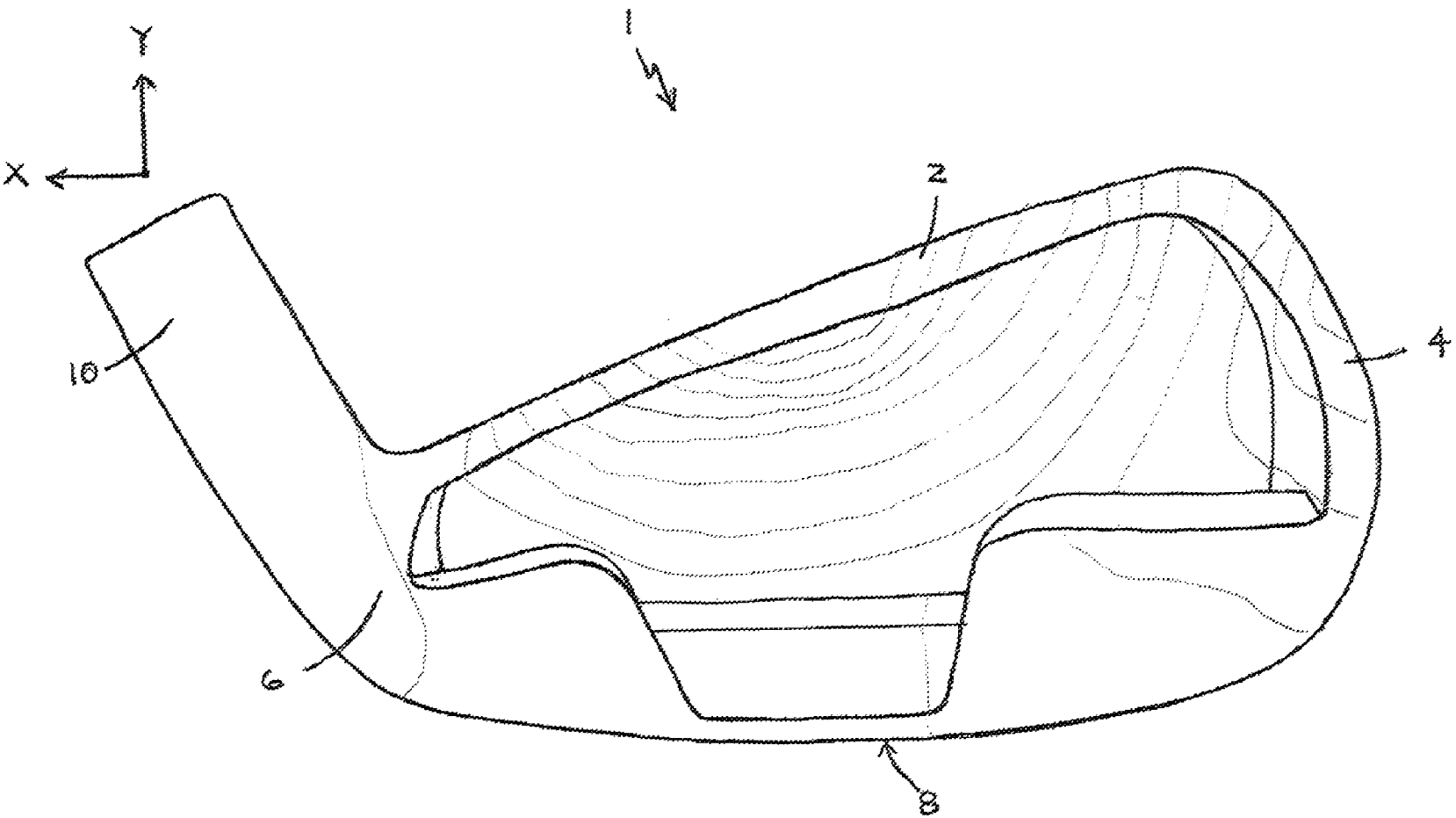
FIG. 7 is a rear view schematically illustrating a top line vibration mode shape of a golf club head.
Figure 8:
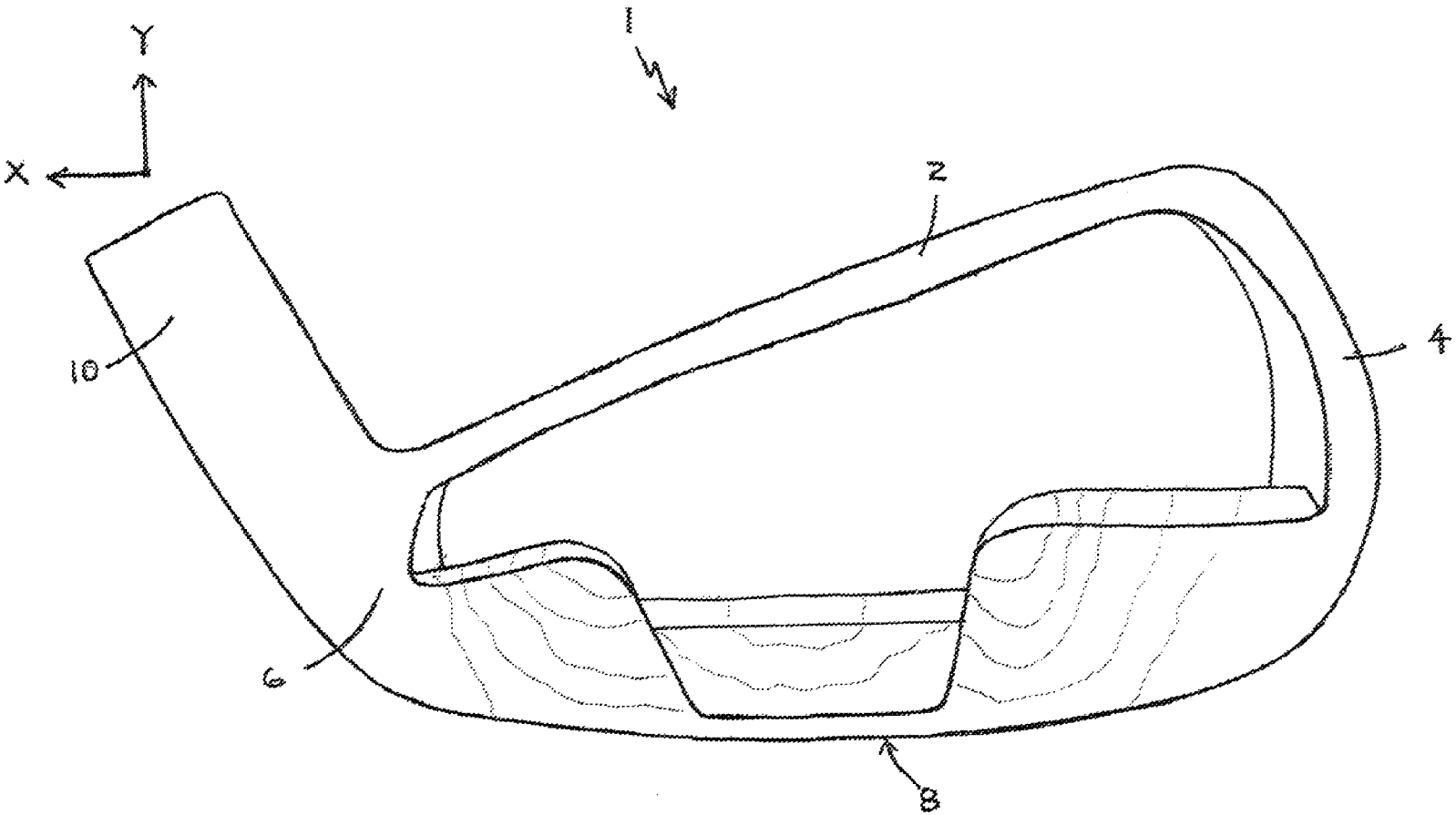
FIG. 8 is a rear view schematically illustrating a sole vibration mode shape of a golf club head.
Figure 9:
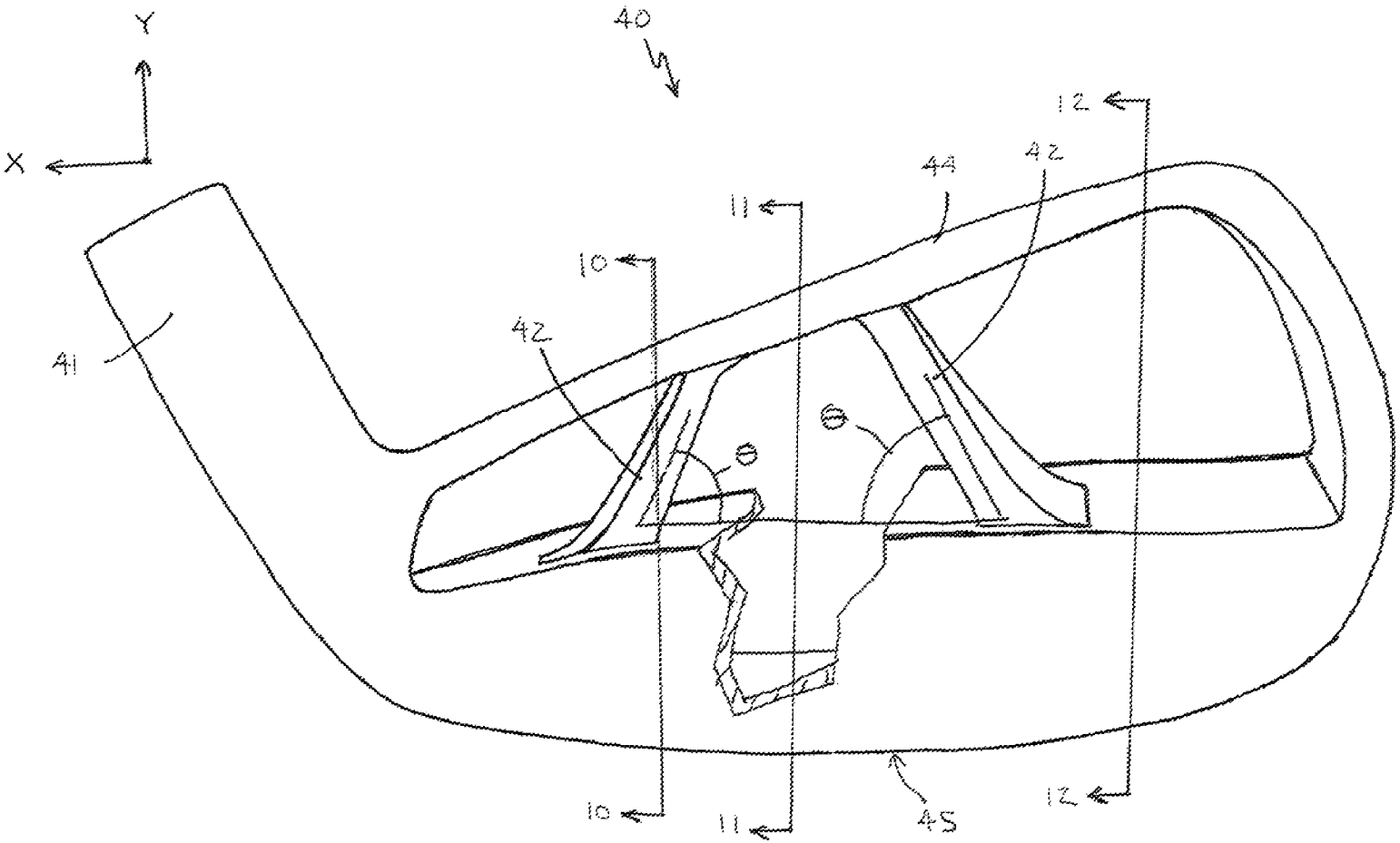
FIG. 9 is a rear view of a golf club in accordance with the present invention.
Figure 12:
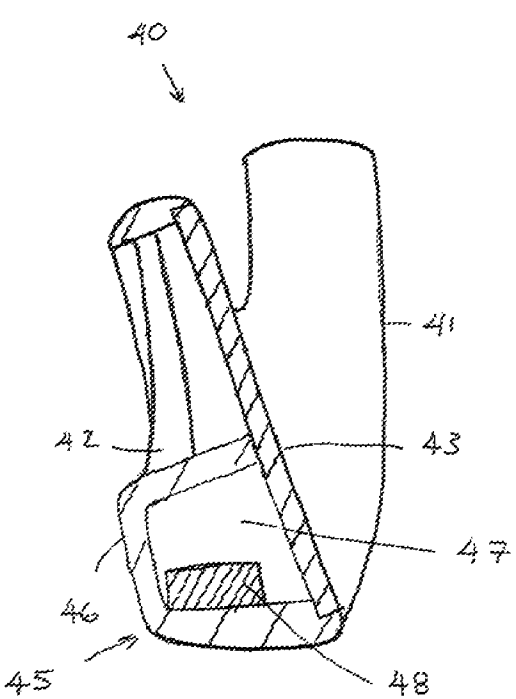
FIG. 12 is a cross-sectional view taken along line 12-12 of FIG. 9.
Figure 11:
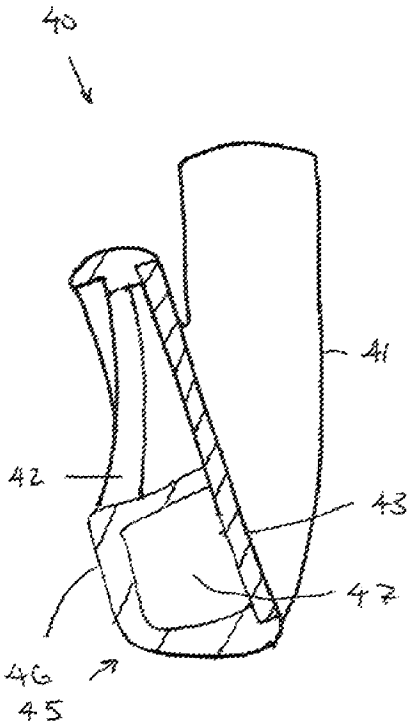
FIG. 11 is a cross-sectional view taken along line 11-11 of FIG. 9.
Figure 10:
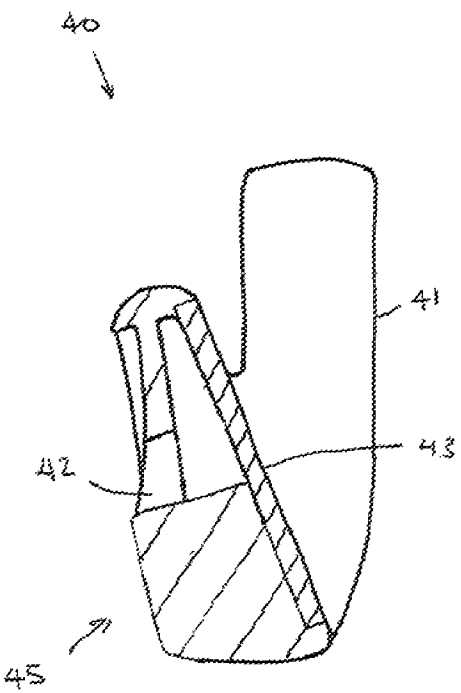
FIG. 10 is a cross-sectional view taken along line 10-10 of FIG. 9.
Figure 13:
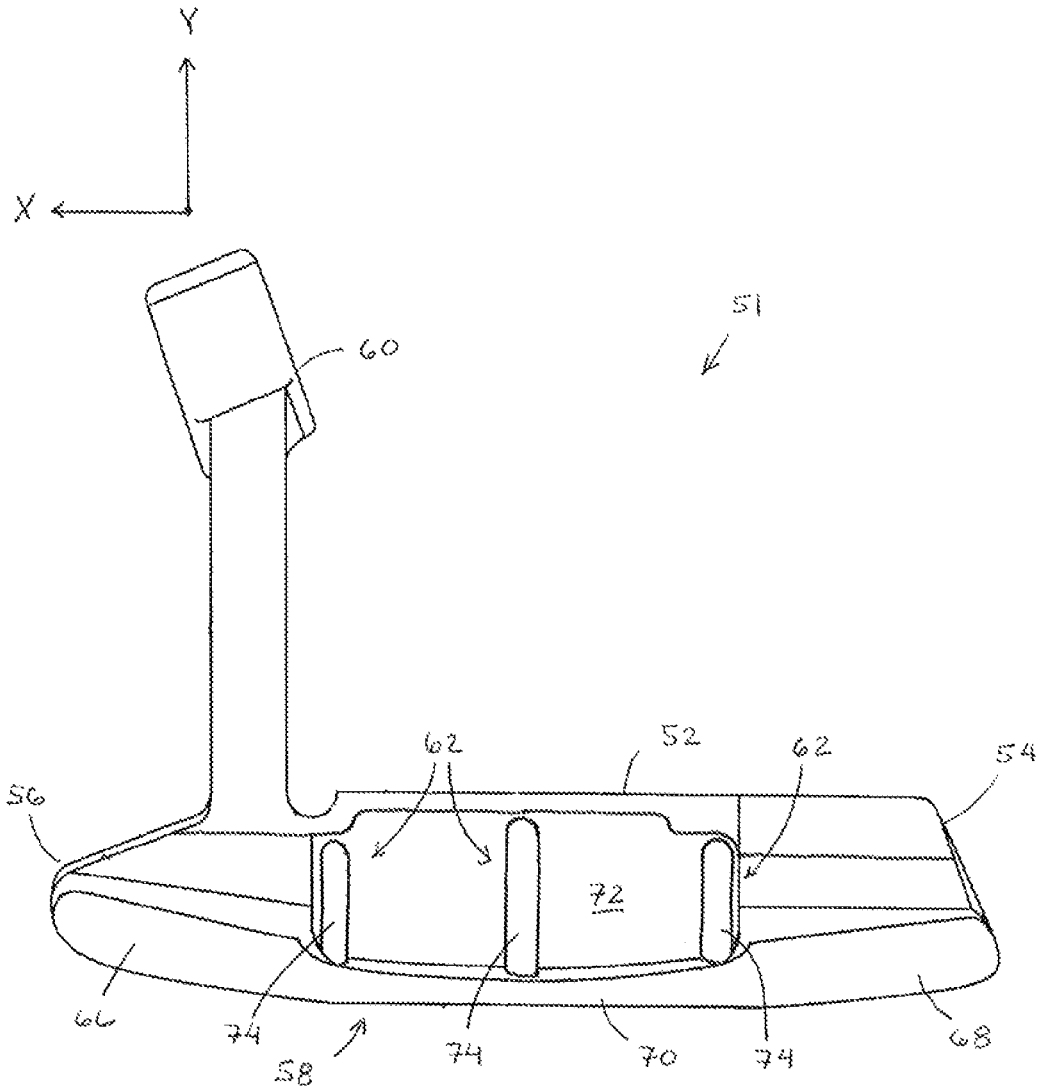
FIG. 13 is a rear view of another golf club in accordance with the present invention.
Figure 14:
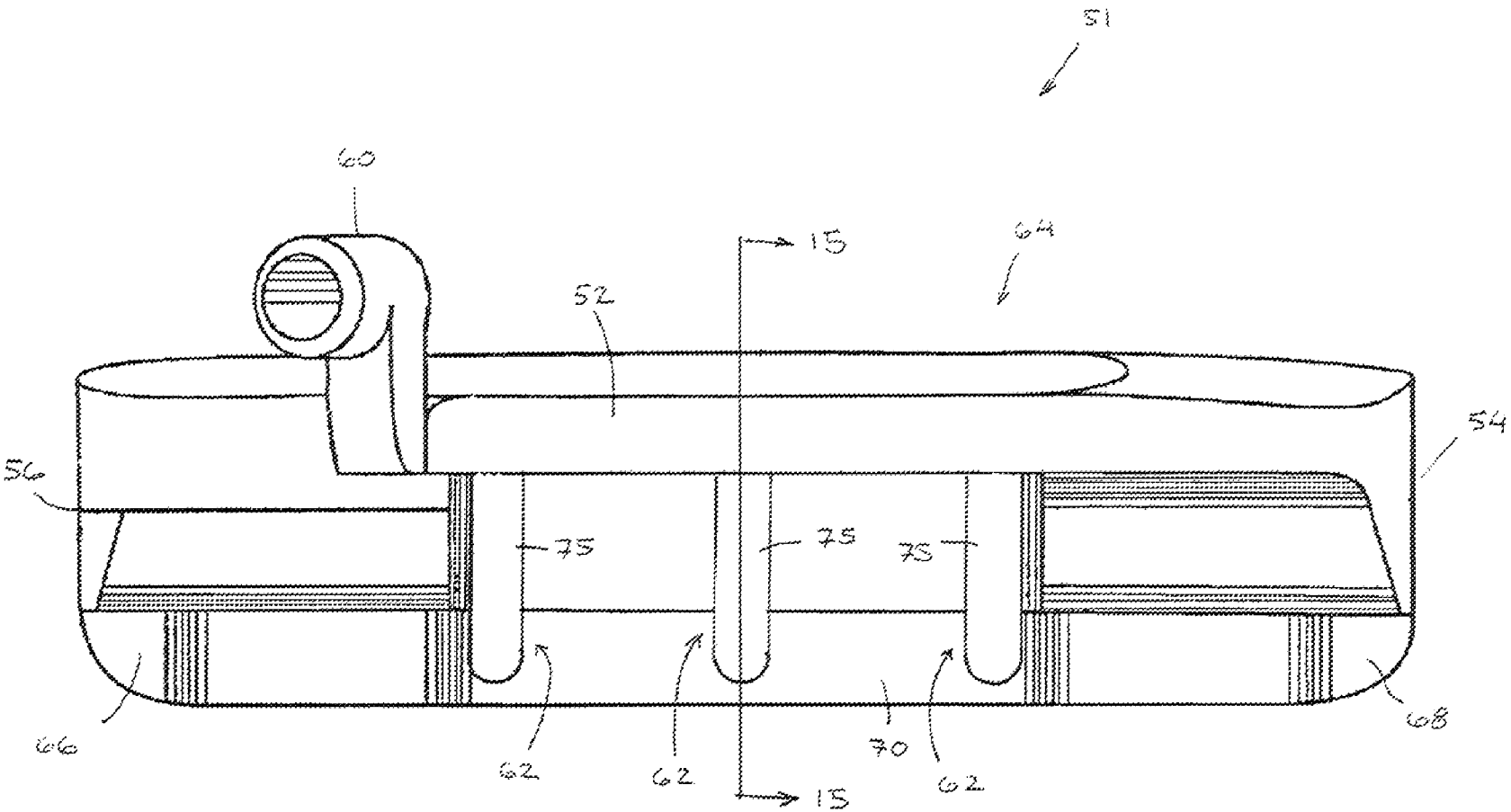
FIG. 14 is a top view of the golf club of FIG. 13.
Figure 15:
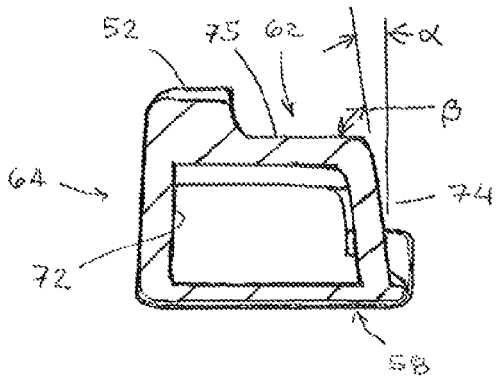
FIG. 15 is a cross-sectional view along line 15-15 of FIG. 14.
Figure 16:
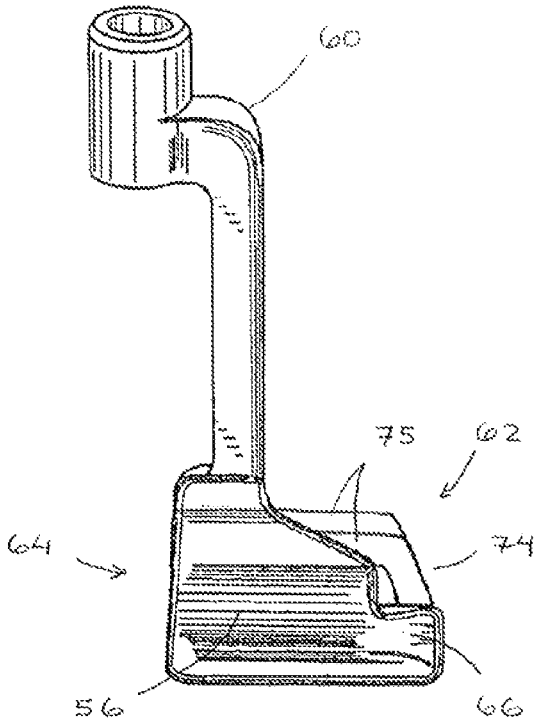
FIG. 16 is a side view of the golf club of FIG. 13.

The analysis determined that the vibration behavior of the club heads included additional vibration modes in other portions of the golf club head at different frequencies. For example, in another vibration mode, the golf club including a channel back structure and lacking the truss members exhibited another vibration mode including maximum displacement in areas of the sole portion, i.e., a sole vibration mode, corresponding to the heel mass and the toe mass. The club head without the truss members 12, exhibited a sole vibration mode at a frequency of about 5630 Hz, as shown schematically in FIG. 7. In club head 1, truss members 12 increased the frequency of the sole vibration mode to about 6600 Hz. and reduced the displacement magnitude of heel mass 16 and toe mass 18.

The alteration of that vibration behavior was achieved by utilizing truss members 12 to couple portions of the golf club head that are out of phase at each of the frequencies of the target modes. For example, in the top line vibration mode, the sole portion exhibits a small displacement magnitude relative to the top line. Similarly, in the sole vibration mode, the top line exhibits a small displacement magnitude relative to the sole portion. In embodiments in which the truss members couple two areas of maximum displacement, it is preferred that the frequencies of the vibration modes are below 10,000 Hz and more preferably, at least one of the frequencies is also less than 5500 Hz.

Truss members 12 are constructed to extend between top line 2 and heel mass 16 and toe mass 18 of sole portion 8 to reduce the displacement of those portions in the different vibration modes and to alter the vibration frequencies of the vibration modes. Truss members 12 support top line 2 and allow mass to be removed from face 14 by providing the ability to include a thinner face 14 because of the supported top line. In particular, truss members 12 provide support to top line 2 and increase its stiffness so that the overall structural integrity of the golf club head is maintained even with a thinner face. As a result, the inclusion of truss members 12 provides additional discretionary mass that can be more advantageously located to provide additional forgiveness by increasing the moment of inertia of the club head or by altering the location of the center of gravity.

The truss members may extend across the rear cavity at any selected angle. For example, they may be parallel, convergent or divergent toward the top line. Preferably, however, truss members 12 are angled relative to each other so that they are convergent toward top line 2. In particular, truss members 12 are angled relative to an XZ plane, that is generally horizontal relative to the golf club when it is in an address position, by an angle θ, that is between about 20° and about 90°. More preferably, angle θ is between about 40° and about 70°. Additionally, the truss members may be spaced from each other or they may converge so that they are immediately adjacent each other at an end.

Truss members 12 may have any construction to provide any desired rigidity, but it is preferred that truss members 12 are constructed to rigidly couple the portions of the golf club head and so that their weight is minimized. Preferably, the weight of the truss members is less than about 12 grams and more preferably less than about 8 grams.

The truss members may be constructed as solid or hollow members. They may also have any cross-sectional shape such as I-beams, C-beams, curved, polygonal and the cross-sectional shape may change over the length of the truss member. For example, in the illustrated embodiment, the cross-sectional area of each truss member 12 decreases toward top line 2. Preferably, truss members 12 are rigid so that portions of the perimeter body are rigidly coupled.

Face 14 is preferably made from a lower density material than the perimeter body and hosel 10 to locate the center of gravity lower and further back and to increase moment of inertia and sweet spot size to improve the golfer's chances for effective ball-striking. Truss members 12 may be constructed from a material that is the same or different from any other portion of the club head. Preferably, truss members 12 are constructed from the same material as the portions to which they are attached. In particular, truss members 12 are attached to portions of top line 2 and sole portion 8 all of which are constructed from the same material. Face 14, the perimeter body, hosel 10 and truss members 12 may all be constructed from the same material. Preferably, face 14 has a density in the range of about 4 g/cm$^3$ to about 8 g/cm$^3$ and the perimeter body, hosel 10 and truss members 12 have a density in the range of about 9 g/cm$^3$ to about 19 g/cm$^3$. Suitable materials for the portions of the club head, including the truss members, include, but are not limited to, aluminum, stainless steel, titanium, tungsten, and alloys thereof. These material alternatives are applicable to all of the embodiments described herein.

Truss members 12 may be formed integral with face 14 and/or any portion of the perimeter body such as by being cast as a unit, or they may be separate components that are coupled to face 14 and/or the perimeter body in a secondary coupling procedure. Alternatively, the truss members may be coupled using any coupling technique, such as welding, soldering, brazing, swaging, etc. Additionally, truss members 12 may be removably coupled, or semi-permanently coupled, to face 14 and/or the perimeter body such as by using removable fasteners, or adhesive.

Further vibration tuning is accomplished using one or more damping inserts 26. Damping inserts 26 are inserted at least partially into channel 24 and abut rear surface 22 of face 14 and a forward surface 28 of sole portion 8. Damping inserts 26 may be compressed between face 14 and sole portion 8 or sized to slidably fit into a portion of channel 24. Damping inserts 26 may be constructed from any metallic or non-metallic vibration damping material, such as polyurethane, aluminum, nylon 6-6, silicone, viscoelastic adhesive, etc. Additionally, the damping inserts may be constructed of both damping and non-damping materials, such as rigid plastic with viscoelastic adhesive. In embodiments utilizing multiple damping inserts 26, the inserts may be constructed to provide different amounts of dampening at different locations, such as by utilizing different materials and dimensions.

Additional inserts may be incorporated into the rear cavity and coupled to rear surface 22 of face 14. As shown, the rear cavity of the golf club head is generally split into a heel portion, a central portion and a toe portion by truss members 12 when viewed from the rear of the golf club head. Golf club head 1 includes a plurality of cavity inserts, including a heel cavity insert 30, a central cavity insert 32 and a toe cavity insert 34. Each cavity insert may cover all or any portion of the rear surface of face 14 within the respective cavity portion.

The cavity inserts are generally coupled to back surface 22 of face 14. Each of heel cavity insert 30, central cavity insert 32 and toe cavity insert 34 has a cup-shaped structure including a base 36 and a side wall 37. Base 36 is generally planar and includes an attachment surface that is coupled to back surface 22 and an exposed surface 38 that may include indicia, logos or other markings. Side wall 37 extends aft ward from base 36 and abuts a portion of the perimeter body and the adjacent truss member 12.

Figure 5:
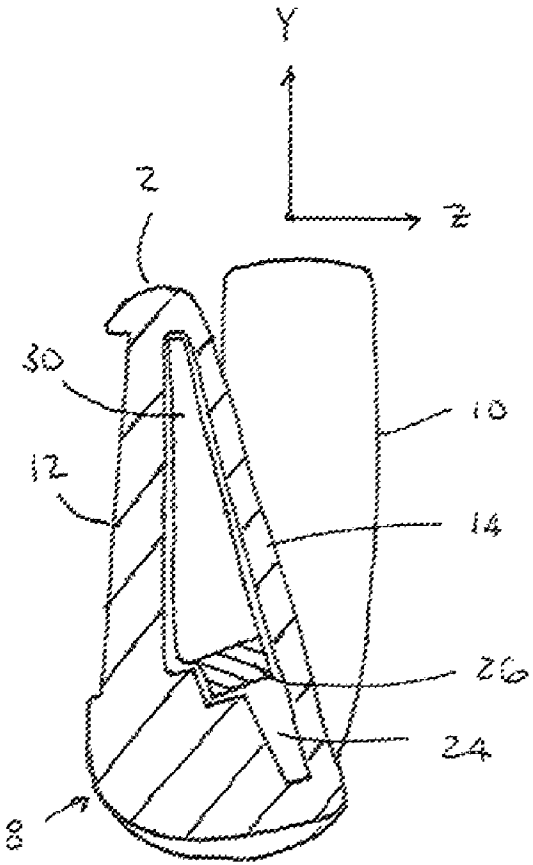
FIG. 5 is a cross-sectional view taken along line 5-5 of FIG. 1.

Alternate constructions of truss members 12 are illustrated in FIGS. 5 and 6, which generally correspond to a cross-sectional view of the truss member through line 5-5, shown in FIG. 1. The truss members may extend aft ward from face 14 or they may be spaced from the rear surface of face 14. As shown in FIG. 5, truss member 12 is spaced from face 14 so that a gap is formed therebetween. One or more of the cavity inserts may be configured to fit within, or partially within, the gap so that it abuts both face 14 and truss member 12. In particular, the toe ward edge of insert 30 extends in the gap between face 14 and truss member 12 and is sized to generally match the shape of the gap which has a greater fore-aft dimension in a lower portion than at an upper portion. Additionally, the height of insert 30 may be selected so that a lower portion abuts an upper surface of damping insert 26. Preferably, insert 30 is sized to abut truss member 12, face 14, damping insert 26 and the other adjacent side walls of the perimeter body to seal channel 24. Preferably, in embodiments including spaced truss members, the truss members are spaced from the face over the entirety of the length of the truss member so that the stiffness of the face is not increased directly from the truss member.

In another example, shown in FIG. 6, truss member 12 extends aft ward from face 14 such that there is no gap therebetween over the length of truss member 12. In that construction the rear cavity of golf club head 1 is divided so that there are three discrete and separate portions. Each of the discrete and separate portions of the rear cavity may include an insert such as the cavity inserts described above. Additionally, channel 24 may be separated into a plurality of discrete portions by truss members 12. Preferably, if inserts are included, the perimeter of each insert abuts the adjacent side walls of the respective cavity portion. Additionally, each of the plurality of discrete portions of channel 24 may further include one or more damping inserts 26.

Another embodiment of the golf club head of the present invention is illustrated in FIGS. 7-10. Golf club head 40 is constructed as a perimeter weighted golf club head and comprises a perimeter body, a hosel 41, a plurality of truss members 42 and a face 43.

The perimeter body includes a top line 44, a toe portion, a heel portion, and a sole portion 45. Sole portion 45 of the perimeter body is coupled to a back surface of face 43 at the perimeter and over a lower portion thereof to form a lower muscle portion. Face 43 is disposed on the perimeter body and provides a front ball striking surface. In all of the described embodiments, the face may be an integral part of the perimeter body or it may be constructed separately as a face insert, as shown in FIGS. 9-12, and coupled to the perimeter body. A construction including a face insert may be selected to simplify the manufacture of the golf club head. For example, in channel back constructions or hollow muscle back constructions and constructions including truss members that are spaced from the face, those features can be difficult, or impossible, to create using casting or forging with an integral face, but by including a face insert the construction becomes easier to manufacture.

The combined perimeter body and face 43 define a rear cavity in an upper portion of golf club head 40. Hosel 41 is disposed on a heel end of face 43 and the perimeter body, and provides an attachment to a shaft so that club head 40 may be assembled into a complete golf club.

Sole portion 45 may be constructed as a solid or hollow muscle back portion. In the illustrated embodiment, sole portion 45 is constructed so that at least a portion of it is formed by a muscle back shell 46 that combines with face 43 to define an enclosed cavity 47. Muscle back shell 46 may be manufactured as a separate component that is coupled to the remainder of the perimeter body or as an integral part of the perimeter body. It should be appreciated that sole portion 45 may be entirely hollow, solid, or it may incorporate both hollow and solid portions. Furthermore, one or more weight members 48 may be included in hollow portions of sole portion if desired.

Truss members 42 extend from sole portion 45 across the rear cavity and are coupled, at an upper end, to top line 44. As a result, truss members 42 couple top line 42 to sole portion 45 to alter the vibration characteristics of golf club head 40. As described above, the truss members may be spaced from a rear surface of the face or they may extend aft ward from the face so that there is no space between the truss member and the face over the length of the truss member.

Referring now to FIGS. 13-16, in another embodiment, golf club head 51 is configured as a putter-type golf club head. Golf club head 51 includes a perimeter body, a hosel 60, at least one truss member 62 and a face 64.

The perimeter body includes a top line 52, a toe portion 54, a heel portion 56, and a sole portion 58 and provides mass distribution that of golf club head 51 that increases the moment of inertia by concentrating the mass of the club head at the perimeter of face 64. Sole portion 58 may further include mass concentrations to further tune the mass properties of club head 51. For example, in the present embodiment, sole portion 58 includes a heel mass 66 and a toe mass 68 and a central portion 70 having a reduced height that combine to increase the moment of inertia about a Y-axis extending through the center of gravity of golf club head 51. Face 64 combines with the perimeter body to define a rear cavity.

Hosel 60 is disposed on a heel end of face 64 and the perimeter body, and provides an attachment to a shaft so that club head 51 may be assembled into a complete golf club. Hosel 60 may be constructed integral with face 64 and/or the perimeter body. Hosel 60 may also be constructed from the same or different material than face 64 and/or the perimeter body.

Golf club head 51 includes at least one truss member 62. In the present embodiment, a plurality of truss members 62 extends from sole portion 58 to a back surface 72 of face 64 across a portion of the rear cavity. Preferably, truss members 62 extend to at least one portion of club head 1 that exhibits maximum displacement in at least one vibration mode in a frequency of less than about 8500 Hz.

Truss members 62 extend from central sole portion 70 to back surface 72 of face 64 and are generally formed of a first portion 74 extending from sole portion 58 and a second portion 75 extending between first portion 74 and back surface 72. First portion 74 extends generally upward from central sole portion 70 at an angle $\alpha$ with respect to a vertical reference plane. Angle $\alpha$ may be positive, negative or zero, and is generally in a range of about −45° to about 60°, but is preferably in a range of about 0° to about 45°. Second portion 75 extends generally laterally from first portion 74 to back surface 72 of face 64 adjacent top line 52. Second portion 75 is angled relative to first portion 74 by an angle $\beta$. Angle $\beta$ is in a range of about 0° to about 135°, but is preferably in a range of about 45° to about 90°.

As shown, the plurality of truss members 62 includes three truss members 62, but it should be appreciated that any number of truss members 62 may be included. Furthermore, it should be appreciated that the truss members may have any cross-sectional shape. For example, the cross-sectional shape may be circular, polygonal, I-beam shaped, channel shaped, etc.

Truss members 62 may be formed integral with face 64 and/or any portion of the perimeter body or they may be separate components that are coupled to face 64 and/or the perimeter body in a secondary coupling procedure.

Additionally, truss members 62 may be removably coupled, or semi-permanently coupled, to face 64 and/or the perimeter body. For example, truss members 62 may be attached using removable fasteners, or adhesive.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A golf club head, comprising:

a perimeter body including a top line and a sole portion;

a face disposed on a front portion of the perimeter body, wherein the face and the perimeter body define a rear cavity and wherein the face and the sole portion are coupled at a periphery of the face to define a channel between the sole portion and the face;

a hosel disposed at a heel end of the face and the perimeter body, wherein in the combined perimeter body, face and hosel, at least one of the top line and sole portion include an area exhibiting maximum displacement of a vibration mode in a frequency less than 5500 Hz; and at least one truss member extending across at least a portion of the rear cavity and mechanically coupling the sole portion and the top line.

2. The golf club head of claim 1, wherein the area of the top line exhibits maximum displacement of a vibration mode in a frequency of about 3500 Hz to about 5000 Hz.

3. The golf club head of claim 1, wherein the sole portion includes a heel mass and a toe mass and a central sole portion.

4. The golf club head of claim 3, wherein the at least one truss member includes a pair of truss members, wherein a first truss member extends between the heel mass and the top line, and wherein a second truss member extends between the toe mass and the top line.

5. The golf club head of claim 4, wherein the first and second truss members are convergent from the sole portion to the top line.

6. The golf club head of claim 1, wherein the at least one truss member is spaced from a rear surface of the face.

7. The golf club head of claim 1, wherein the at least one truss member extends from a rear surface of the face.

8. A golf club head, comprising:

a perimeter body including a top line and a sole portion that forms a lower muscle portion, wherein the lower muscle portion is at least partially hollow to define a lower cavity;

a face disposed on a front portion of the perimeter body, wherein the face and the perimeter body define an upper rear cavity in an upper portion of the golf club head;

a hosel disposed at a heel end of the face and the perimeter body, wherein in the combined perimeter body, face and hosel, at least one of the top line and sole portion include an area exhibiting maximum displacement of a vibration mode in a frequency less than 5500 Hz; and at least one truss member extending across at least a portion of the upper rear cavity and mechanically coupling the sole portion and the top line.

9. The golf club head of claim 8, wherein the lower muscle portion comprises a muscle back shell comprising a material different than a material of the face.

10. The golf club head of claim 8, further comprising a weight member disposed within lower cavity.

11. The golf club head of claim 10, wherein the weight member is fully enclosed by the lower muscle portion and the face.

12. A golf club head, comprising:

a perimeter body including a top line and a sole portion;

a face disposed on a front portion of the perimeter body, wherein the face and the perimeter body define a rear cavity;

a hosel disposed at a heel end of the face and the perimeter body, wherein in the combined perimeter body, face and hosel an area of the top line exhibits maximum displacement of a top line vibration mode in a frequency less than 4500 Hz; and at least one truss member extending across at least a portion of the rear cavity and mechanically coupling an area of the sole portion and an area of the top line, wherein the truss member increases the frequency of the top line vibration mode to greater than 4500 Hz.

13. The golf club head of claim 12, wherein in the combined perimeter body, face and hosel an area of the sole portion exhibits maximum displacement of a sole vibration mode in a frequency less than about 6000 Hz.

14. The golf club head of claim 12, wherein the top line vibration mode has a frequency between about 3000 Hz and about 4500 Hz.

15. The golf club head of claim 12, wherein the sole portion includes a heel mass and a toe mass and a central sole portion having a reduced height relative to the heel mass and the toe mass.

16. The golf club head of claim 15, wherein the at least one truss member includes a pair of truss members, wherein a first truss member extends between the heel mass and the top line, and wherein a second truss member extends between the toe mass and the top line.

17. The golf club head of claim 16, wherein the first and second truss members are convergent from the sole portion to the top line.

18. The golf club head of claim 12, wherein the at least one truss member is spaced from a rear surface of the face.

19. The golf club head of claim 12, wherein the at least one truss member extends from a rear surface of the face.

* * * * *